United States Patent [19]

Seragnoli

[11] 3,967,543

[45] July 6, 1976

[54] APPARATUS FOR SHAPING, WHILE TRANSFERRING, UNDERSTRIPS OF HINGE LID CIGARETTE PACKETS

[75] Inventor: Enzo Seragnoli, Bologna, Italy

[73] Assignee: G. D Societa Per Azioni, Italy

[22] Filed: Nov. 8, 1974

[21] Appl. No.: 522,457

[30] Foreign Application Priority Data

Dec. 20, 1973 Italy ..... 3543/73

[52] U.S. Cl. ..... 93/36.01; 83/152; 83/161; 93/39 R; 93/44.1 R; 93/57; 93/12 C

[51] Int. Cl.[2] ..... B31B 1/16; B31B 1/52

[58] Field of Search ..... 83/152, 154, 451, 159, 83/161; 93/57, 12 C, 12 R, 36.01, 37 R, 37 SP, 39 R, 55, 55.1 P, 44, 44.1

[56] References Cited

UNITED STATES PATENTS

| | | | |
|---|---|---|---|
| 1,920,761 | 8/1933 | Müller | 93/39 R |
| 2,130,235 | 9/1938 | Heyman | 83/152 |
| 2,591,135 | 4/1952 | Chalmers et al. | 93/39 R X |
| 2,870,584 | 1/1959 | Sherrill | 93/12 C |
| 3,176,558 | 4/1965 | Gustavson | 83/152 X |

*Primary Examiner*—James F. Coan
*Attorney, Agent, or Firm*—Robert E. Burns; Emmanuel J. Lobato; Bruce L. Adams

[57] ABSTRACT

A device for shaping and transferring the understrip for a packet of the hinge lid type. The device comprises an oscillating and axially moving arm for transferring blanks for understrips, one at a time, from an area of production thereof toward and into an understrip shaping and receiving station and onto a conveyor belonging to the wrapping line and provided with a plurality of compartments which halt in succession in the shaping and receiving station. While the transfer takes place the understrips are U-shaped, and additionally shaped to make them ready for use on the wrapping line.

10 Claims, 3 Drawing Figures

APPARATUS FOR SHAPING, WHILE TRANSFERRING, UNDERSTRIPS OF HINGE LID CIGARETTE PACKETS

BACKGROUND OF THE INVENTION

This invention has as its subject a device for transferring and shaping ready for use on cigarette packing machines, the understrip or 'shoulder piece' incorporated internally in each packet of the hinge lid type.

DESCRIPTION OF THE PRIOR ART

The understrip constitutes a vital part of this type of packet. The packet as is known, is produced by a cardboard blank being subjected to a number of folding operations and having one of the said understrips bonded to it.

The final result is a box or parallelepiped packet of the type shown in FIG. 1, comprising a body 1 and a lid 2 which are interconnected by means of a hinge 3.

At 4 there is an understrip or shoulder piece bonded internally to the body 1, and this piece is made up of a center panel 5 and two identical side pieces 6.

Each side piece 6 is separated from the center panel 5 by a series of indentations 7 along which the folds are made. The indentations 7 have notches 8, the purpose of which will be seen in due course (see also FIG. 2).

As can be seen from FIG. 1, the understrip, which has its center panel 5 bonded to the front, and its side pieces 6 bonded to the lateral walls, of the body 1, protrudes above that part of the packet where the opening is, in such a way as to create continuity and seal the opening between the body 1 and the lid 2 once the packet is closed.

Protrusions 8' are formed, at the time the side pieces 6 are folded where the previously mentioned notches 8 are located. The protrusions serve to increase the contact between the understrip 4 and the lid 2 and to lock the latter down when the packet is closed.

An examination of FIG. 1 will show that the two uppermost corners 9 of the understrip 4, placed in proximity of the hinge 3, have been slightly curved towards the inside of the body 1 so as to assist the lid 2 to be closed and to slide onto the side pieces 6 when the packet is being closed.

Flat blanks for the understrips 4 can be produced according to the description given, for example, in patent application Ser. No. 522,299 filed Nov. 8, 1974 in the name of the same Applicant as herein, out of a continuous flat web of cardboard material N (see FIG. 2) on which two longitudinal lines of indentations 7 are made, punctuated every so often by the notches 8.

The web for understrips or shoulder pieces 4, thus produced, is subjected to a finishing operation by cutting means belonging to the blank-producing device.

SUMMARY OF THE INVENTION

The object of the present invention is to make available a device for transferring the blanks for understrips or shoulder pieces, produced, for example, in the way briefly described above, to the wrapping line of a machine for packing cigarettes in packets of what are known as the hinge lid type and, at the same time, to shape the understrips ready for use on the said line.

The subject matter of the present invention is, therefore, a device connected to a machine for packing cigarettes in packets of the hinge lid type and working in conjunction with means on which the understrips or shoulder pieces are produced and with a wrapping line for the packing machine. The device according to the invention comprises an oscillatable and axially movable arm for shaping the understrip blanks, while transferring them, one at a time, from the production area to and through an understrip shaping station. The device also has gripper means for additionally shaping the understrips while transferring them from this station to a second and adjacent station, belonging to the wrapping line and provided with a plurality of compartments movable intermittently or in steps in such a way that they halt in succession in the second station. Means are thus provided to shape the understrips in a U, and generally ready for use, while they are being transferred from the blank producing area to an adjacent part of the wrapping line.

BRIEF DESCRIPTION OF THE DRAWINGS

Further characteristics and advantages will emerge more clearly from the following detailed description of a preferred form of embodiment for the device according to the invention, illustrated purely as an example on the accompanying drawings in which.

DESCRIPTION OF THE PREFERRED EMBODIMENT

Figure 3:
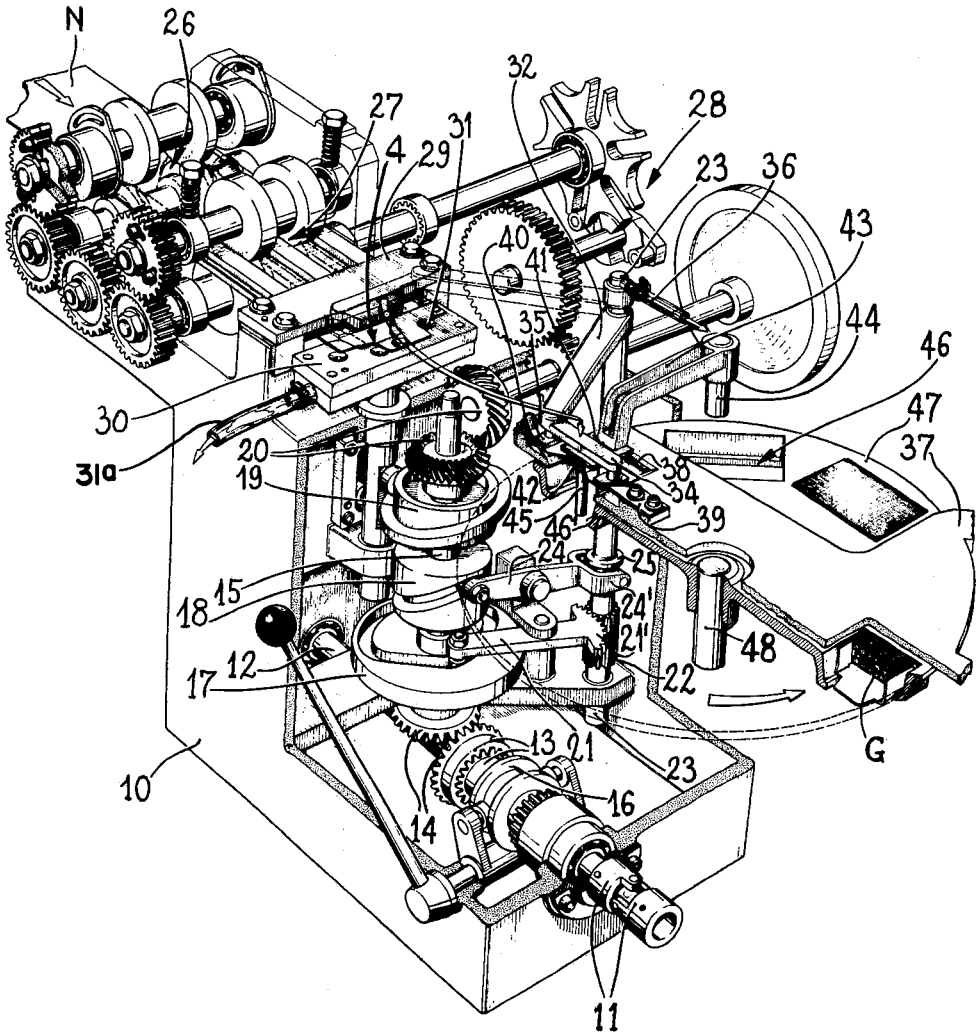
FIG. 3 shows, again in a perspective view; in addition to the means for the production of the above mentioned understrip blanks forming the subject of the previously cited Patent Application in the name of the same Applicant as herein; the device according to the present invention, together with the means for its operation.

With reference to the above mentioned figures and, in particular, to FIG. 3, at 10 there is a bedplate for the device forming the subject of the invention and this is anchored to the frame of the machine for packing cigarettes in packets of the hinge lid type.

The entire device takes it drive from means not illustrated in FIG. 3 but belonging to the aforementioned machine, through a coupling 11 integral with a horizontal shaft 12 which is carried in rotation around its own axis.

From the shaft 12 the drive is passed on, using a dog clutch 13 and a bevel gear and pinion 14, to a vertical shaft 15. The shaft 12 is supported by the bedplate 10.

This mechanical connection can be broken by a cam 16 integral with the above mentioned clutch 13 using manually operated means. Mounted on the vertical shaft 15 from bottom to top, in the order stated, are three cylindrical cams 17, 18 and 19.

Furthermore, the drive is passed on from the upper extremity of shaft 15 to a pair of helical gears 20.

In the race with which the upper side of the cam 17 is provided slides an idle roller mounted on one end of a horizontal lever 21 pivoted at its intermediate point to a pin integral with the bedplate of the device. The other extremity of the lever 21 carries a sector gear 21'.

As the cam 17 rotates, the sector gear 21' oscillates in a horizontal plane and, through a gear 22, causes a vertical shaft 23 supported by the bedplate 10 of the device to oscillate around its own axis.

The middle cam 18 has a race machined into its cylindrical surface in which slides an idle roller carried on one end of a lever 24 pivoted at its intermediate point to a horizontal pin integral with the bedplate 10 of the device.

The other end of lever 24 is shaped in the form of a fork 24' with horizontal prongs provided with idle rollers on horizontal spindles placed, diametrically opposite each other, between two rebates or shoulders 25 with which the shaft 23 is provided.

As the cam 18 rotates, the lever 24 oscillates in a vertical plane and, through the described connection, carries the shaft 23, which is already provided with a rotatory oscillating movement derived from the cam 17, in an axial reciprocating movement.

Figure 2:
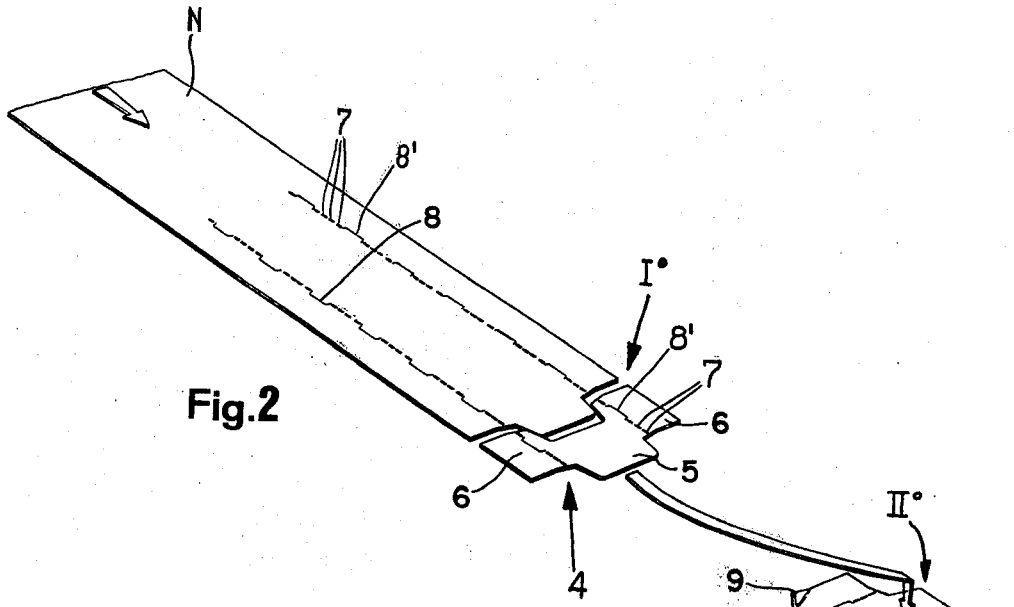
FIG. 2 shows, also in a perspective view, the succession of the various transfer and processing operations to which the understrip material is subjected, including the operations applied to the individual understrip blanks according to the invention.
Figure 1:
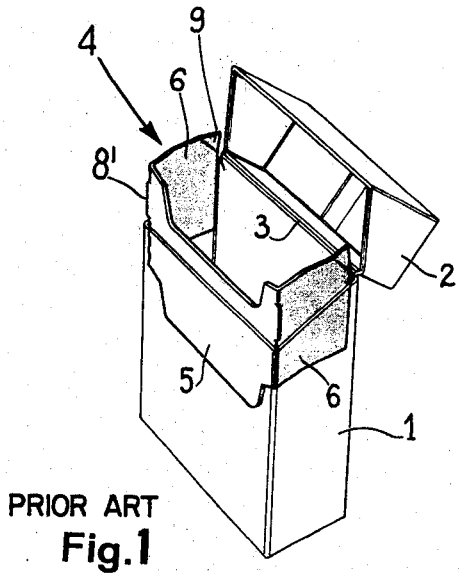
PRIOR ART Fig.1
FIG. 1 shows, in a perspective view, a packet of the known hinge lid type with particular emphasis given to the understrip or shoulder piece.

So far a description has been given of the mechahical connections through which the device forming the subject of the present invention receives its drive and now a description will follow of the various component parts directly concerned in the production and in the transfer of the understrips, as well as of the various processing stages to which these are subjected (see FIGS. 2 and 3).

Flat blanks for the understrips are produced, in the way also described in the above-mentioned application in the name of the same Applicant as herein, through a succession of operations, summarized hereunder:

As a continuous flat web N of cardboard material, unwound from a reel not shown in FIG. 3, moves forward along a horizontal plane, a set of rolls 26 makes in it two rows of indentations 7 parallel with the infeed direction and these are punctuated with notches 8.

A second set of rolls 27 then moves the web N to transversely extending cutting means.

Both sets of rolls 26 and 27 are provided with an intermittent motion derived from a Geneva mechanism 28 driven by the helical gears 20.

The cutting means consist of a stationary knife 29 and a movable knife 30 and these are made out of horizontal plates positioned transversely with respect to the direction in which the web N moves forward.

The movable knife 30 is provided with a number of holes 31, rhythmically connected to suction by pipe means 31*a* and, moved by the previously mentioned uppermost cam 19, it moves vertically up and down. Each time the knife 30 makes an upward movement, it detaches one finished, flat understrip blank 4 from the continuous web N (see position I° in FIG. 2).

This understrip blank 4 which, on account of the suction applied through the holes 31, attaches itself to the upper part of the movable knife 30, is raised by this knife vertically from the cutting plane to the furthermost upward position of this knife, thus completing the production of the understrip blanks. In this position, there is provided a transfer and shaping means, belonging to a first station of the device forming the subject of the present invention, as will now be described.

In this position, in fact, a series of operations is commenced which culminate in finished understrips being fed, as will be seen, into a part, adjacent the blank producing area, of the wrapping line of a machine for packing cigarettes in hinge lid packets.

The transfer means consists of a horizontal arm 32 pivoted to one end of the shaft 23 which, as seen earlier on, is provided with both a movement whereby it oscillates around its own axis and with an axial reciprocating motion. It will be seen from FIG. 3 that the oscillating or swinging movement of arm 32 takes place in a horizontal plane and that the axial motion is vertical and transversal of this plane.

The other extremity of the arm 32 is integral with a horizontal bar 34 and this has on its lower part two horizontal plates 35 with one or more holes (not shown in FIG. 3) drilled in them, which are rhythmically connected, via a pipe 36, to the source of suction.

Upon completing its first oscillating phase under the action of the cam 17, the shaft 23 places the bar 34 transversely with respect to the direction in which the continuous web N moves forward (see the position 34' indicated with a thin line of dots and dashes in FIG. 3).

When in this condition, the plates 35, connected ready to the source of suction and positioned level with the furthermost upward point reached by the movable knife 30, hold on by suction to the two side pieces 6 of the understrip blank 4 (FIG. 2). Advantageously this is done at the very moment when the suction applied through the holes 31 of the knife is cut off.

At this juncture, by undergoing a 90° counter clockwise rotatory oscillation around its own axis, the shaft 23 transfers the understrip blank 4 on to a position slightly above a horizontal fixed plate structure 37 at a point adjacent to a rectangular shaped aperture 38, machined therein, as shown in FIG. 3.

The cam 18 then causes the arm 32 to effect a forcible, vertical, downward sliding movement by which the understrip blank 4, still attached by suction to the plates 35, is inserted in the said rectangular shaped aperture 38.

While the said transfer and insertion takes place, two horizontal blade members 39 fixed to the top side of the plate 37 shape the corners 9 of the side pieces 6 and, for the reasons previously stated, give them a slight curvature (see position II° in FIG. 2).

Upon completion of the downward movement of the arm 32, the understrip 4 arrives at two horizontal stops 40 which are machined in the body of the plate 37 and are positioned at points corresponding to where the two side pieces 6 are located.

At this stage, the suction applied through the pipe 36 is cut off and the arm 32, having completed its task, commences its vertical upward movement, again under the action of the cam 18.

Simultaneously, above and below the center panel 5 of the understrip 4, two rectangular horizontal plates 41 and 42 vertically approach one another, as indicated by FIG. 3, thereby engaging the understrip 4 for additionally shaping it.

The former plate is mounted, through an arm 43, on a vertical shaft 44 which is provided with an axial reciprocating motion and the latter plate is mounted directly on a vertical shaft 45 which is also provided with an axial reciprocating motion as shown in FIG. 4, plates 41, 42 are shorter than bar 34.

The understrip 4, held tightly between the plates 41 and 42 which undergo a synchronous vertical downward movement, is thereby moved through and downwardly from the rectangular aperture 38 while the two side pieces 6 are forced by the stops 40 to be progressively folded upwards where the indentations 7 and the notch 8 have been made (see position III° in FIG. 2).

Immediately beneath the aperture 38 machined into the fixed plate 37, a top-open compartment 46 belonging to a conveyor, shown as a circular plate 47 (carried by a vertical shaft 48 and moved intermittently in a counter clockwise direction by means of a known type), is in a waiting position. The aperture, as shown by FIG. 3, is approximately coextensive with the compartment.

The circular plate 47 is part of a second station of the present device, as shown. This second station also comprises the plates 41, 42. The conveyor plate 47, as shown, also belongs to the wrapping line for the machine used to pack the cigarettes in packets of the hinge lid type. This plate is provided with a plurality of circumferentially located compartments 46 shaped to accept parallelepiped objects and these compartments halt in succession at the point where the shaped understrips 4 are delivered by the two plates 41 and 42.

The bottom of the compartment 46, is partially open, between two tangential borders 46′ to allow the shaft 45 with plate 42 to effect its travel, as shown. The depth of the compartment corresponds to the crosswise dimension of each side piece 6, while the radial dimension of the compartment is the same as the crosswise dimension of the panel 5.

The understrip 4 continues its vertical downward movement guided by the plates 41 and 42 and goes inside and right to the bottom of the compartment 46, with its two side pieces 6 at right angles to the panel 5, thereby providing the final shape of the understrip. The understrip then is ready for transfer toward the point of use (see position IV° in FIG. 2). On completion of the shaping of the understrip, the two plates 41 annd 42 no longer serve any useful purpose and thus the former commences a vertical upward return movement, while the latter continues to move downwards for a certain distance to disengage itself from the circular plate 47.

At the subsequent position IV°, shown in FIG. 2, a batch G of cigarettes, previously wrapped in an inner wrap of lined foil, is inserted into the compartment 46 and into the understrip 4 therein.

During a further halt at another position on the travel of this compartment (not shown), the ensemble consisting of the batch G of cigarettes wrapped in the lined foil and inserted in the understrip 4 can then be transferred from the circular plate 47 to other means used to complete the packet.

I claim:

1. Apparatus for supplying understrips of hinge lid packets to a cigarette wrapping machine, comprising;

a conveyor having mutually spaced compartments, each receptive of an understrip to be combined with a body of a hinge lid packet, the conveyor being operable to move successive ones of said compartments thereof in a plane, into a predetermined waiting position in said plane, adjacent an area of production of successive flat understrip blanks, and subsequently away from said position for use in a cigarette wrapping machine;

a stationary plate structure overlying a portion of the conveyor corresponding to said position and having an aperture substantially coextensive with one of said compartments;

an arm extending in a plane parallel to that of the conveyor and swingable in its plane to individually transfer the successive flat understrip blanks from the area of production thereof toward said adjacent position, one for each compartment;

means for moving the arm transversely of said planes to move each of the successive, transferred blanks into a respective one of said compartments; and means in said aperture in the plate structure for cooperating with the arm in shaping each understrip blank, while it is moved into and at least partly through said aperature, to provide a U-shaped understrip insertable in said body.

2. Apparatus according to claim 1 including a shaft extending transversely of said planes and supporting said arm; and means for oscillating and axially reciprocating the shaft to effect the swinging and the transverse movement of the arm.

3. Apparatus according to claim 1 wherein said planes are horizontal and said compartments face upwardly.

4. Apparatus according to claim 1 including suction means carried by said arm and releasably engageable with successive ones of said blanks for the transfer of the blanks by the swingable arm.

5. Apparatus according to claim 1 in which the plate structure has a first and relatively wide, apertured portion in a plane parallel to and spaced from the conveyor plane, and a second and relatively narrow, apertured portion in an adjacent plane parallel and closer to the conveyor plane, said apertured portions being in line with one another and defining said aperture.

6. Apparatus according to claim 5 wherein said means in the aperture include stop means in the first apertured portion of the plate structure for bending corners of the understrip blanks to enable the understrips to facilitate closing of the respective lids.

7. Apparatus according to claim 6 in which said means in the aperture include stop means in the second apertured portion of the plate structure for the converting of each blank into a U-shaped understrip.

8. Apparatus according to claim 7 including gripper means separate from said arm for moving each blank through the second apertured portion of the plate structure.

9. Apparatus according to claim 8 in which said gripper means include first and second plates releasably engageable respectively with first surfaces of each blank facing away from the conveyor and with second surfaces of each blank facing the conveyor.

10. Apparatus according to claim 9 in which the conveyor compartments have bottoms having openings enabling the second plates to enter and leave the compartments through the openings.

* * * * *